United States Patent [19]

Lundberg

[11] 4,185,949

[45] Jan. 29, 1980

[54] SCREW COMPRESSOR WITH BEARING UNLOADING MEANS

[75] Inventor: Knut A. L. Lundberg, Norrkoping, Sweden

[73] Assignee: Stal Refrigeration AB, Norrkoping, Sweden

[21] Appl. No.: 869,701

[22] Filed: Jan. 16, 1978

[30] Foreign Application Priority Data

Jan. 20, 1977 [SE] Sweden ..... 7700571

[51] Int. Cl.[2] ..... F04C 17/12; F04C 29/00; F16C 19/10; F16C 21/00

[52] U.S. Cl. ..... 418/203; 308/35

[58] Field of Search ..... 418/197, 201, 203; 415/104–107; 308/35

[56] References Cited

U.S. PATENT DOCUMENTS

| | | | |
|---|---|---|---|
| 2,319,913 | 5/1943 | Bentley | 415/105 |
| 2,438,214 | 3/1948 | Horger | 308/35 |
| 3,947,163 | 3/1976 | Olofsson | 418/203 |
| 4,000,559 | 1/1977 | Korrenn et al. | 308/35 |

FOREIGN PATENT DOCUMENTS

| | | | |
|---|---|---|---|
| 689647 | 4/1953 | United Kingdom | 308/35 |
| 1325471 | 8/1973 | United Kingdom | 418/203 |

*Primary Examiner*—John J. Vrablik
*Attorney, Agent, or Firm*—Cyrus S. Hapgood

[57] ABSTRACT

In a screw compressor, an axial force is transmitted from the rotor shaft to the housing by way of an anti-friction bearing including first and second bearing rings and roll bodies therebetween, the first ring being mounted on the shaft while the second ring is supported axially by the housing and is movable radially relative to the housing. A piston mounted concentrically on the shaft is operable by a fluid pressure to decrease the axial force transmitted to the housing, and the piston sealingly cooperates with a surface which is stationary relative to the second bearing ring.

4 Claims, 2 Drawing Figures

SCREW COMPRESSOR WITH BEARING UNLOADING MEANS

Figures 1, 2:
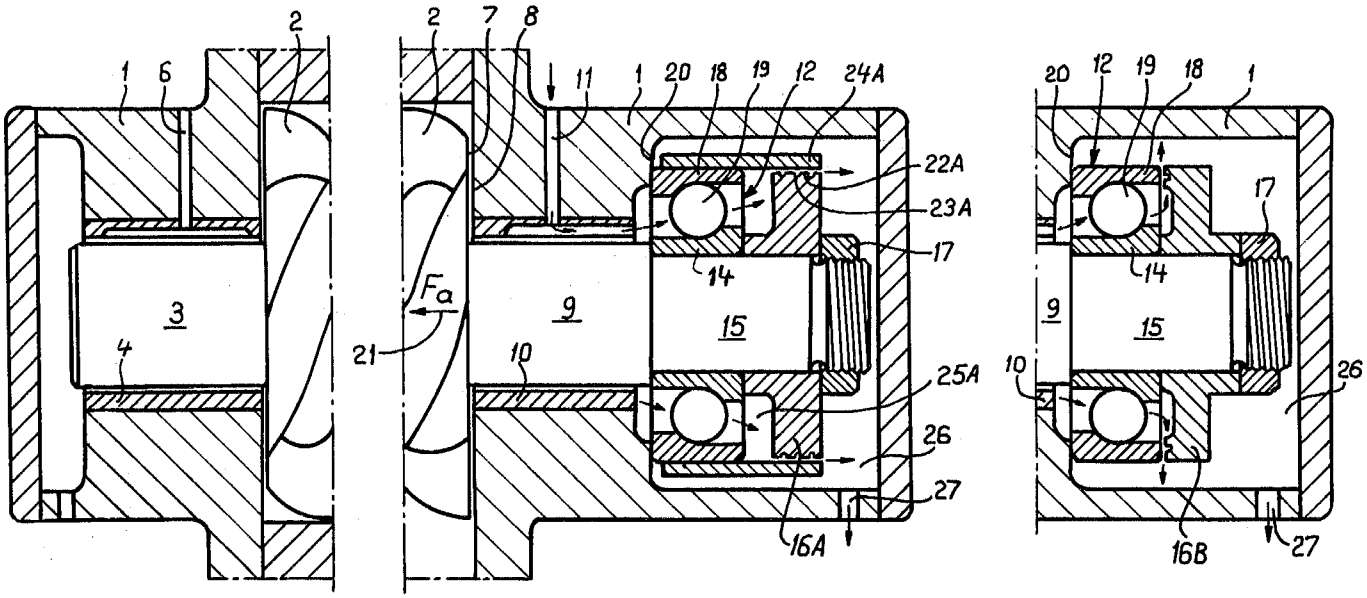

This invention relates to a screw compressor having means for decreasing an axial force transmitted from a rotor shaft to the housing of the compressor by an antifriction bearing, the latter comprising a first bearing ring and a second bearing ring and roll bodies located between the bearing rings, the rotor shaft being rotatably journalled in the housing with a radial clearance. The first bearing ring is mounted on the shaft, the second bearing ring being supported in the axial direction by the housing and radially movable relative to the housing. A piston is arranged on the rotor shaft in concentric relationship with the shaft and is acted upon by a pressure of a fluid so that said axial force is decreased.

Two different embodiments of such a force-decreasing means are known through East German Patent No. 80,961. In both embodiments, the shaft of the rotor is journalled in the radial direction by a couple of slide bearings and in the axial direction by an antifriction bearing. In order that the slide bearings shall work, it is required that the shaft can move in them in the radial direction. Therefore, the antifriction bearing of the known arrangement is journalled so that it is radially movable relative to the housing. The piston, which is arranged to decrease the axial force transmitted by the antifriction bearing and thus give it a satisfactory length of life, is mounted on the shaft and cooperates sealingly in one of said embodiments with a surrounding sleeve. The latter is movable in the radial direction in the housing and also seals in the axial direction against the housing. In the other embodiment of the known arrangement, the piston includes a piston ring movable in the radial direction relative to the piston and which cooperates sealingly with a surrounding sleeve, the latter being stationary relative to the housing.

Both known embodiments have the disadvantages that wear arises on the surfaces where the piston or the piston ring sealingly cooperates with the surrounding sleeve, as there are no means to prevent the piston or piston ring from coming into contact with the surrounding sleeve. This wear means that the sealing space at said surfaces will widen, which has the result, if the fluid flow to the piston is not increased, that the axial force on the piston decreases, whereby the axial force on the antifriction bearing increases so that its length of life decreases. If, instead, the fluid flow is increased so that the axial force on the piston is not changed despite said wear, the increased fluid flow will require a correspondingly increased pumping action, which naturally has a negative influence on the efficiency of the compressor.

Moreover, further wear will arise in the known arrangement because of the movement of the shaft in the radial direction in the slide bearings. This further wear will occur where the antifriction bearing bears against the housing and also where said sleeve bears axially against the housing and where the piston ring bears axially against the piston.

These inconveniences are avoided in the arrangement according to the present invention, where the piston cooperates sealingly with a surface which is stationary relative to the second bearing ring. In this way, the piston and the surface cooperating with it can follow each other on the radial movement of the shaft, with a sealing space (sufficiently narrow for the purpose) between said piston and surface, without contact between the piston and said surface.

Furthermore, the arrangement according to the invention has only one place where wear takes place as a consequence of the radial movement of the shaft. This place is where the antifriction bearing bears against the housing. The arrangement according to the invention is also simpler in structure than the known arrangement.

According to a further development of the invention, the second bearing ring is located (as seen in the axial direction) between its support against the housing and the piston. This provides a structurally simple arrangement of the piston, the antifriction bearing and the adjoining slide bearing. Also, the arrangement allows said slide bearing and antifriction bearing to be simply lubricated by the same fluid which acts on the piston in the axial direction.

Another development of the invention includes an annular element which protrudes axially from the second bearing ring towards the piston, the piston being arranged to cooperate sealingly with the annular element. In this way, a sealing with an annular sealing space is easily obtained, the length of the sealing space in the flow direction of the fluid through the space being easy to adapt to the prevailing sealing need. The force on the piston can also be modified by changing the diameter of the annular element and of the piston at the sealing space.

According to another development of the invention, the piston is arranged to cooperate sealingly directly with the second bearing ring. A structurally simple arrangement is thus obtained, which can be quite satisfactory for certain applications.

Two embodiments of the invention are described below in connection with the attached drawing, in which FIG. 1 is a longitudinal sectional view of a screw compressor with a piston to unload an antifriction bearing from an axial force, and FIG. 2 is a similar view of another embodiment of the unloading piston.

A housing 1 of a screw compressor encloses two rotors of screw form, of which only one is shown at 2 in the drawing. From one end surface of the rotor a first shaft 3 protrudes, which is journalled in the radial direction in a bearing sleeve 4, to which lubricant (oil) is supplied through a channel 6.

From the other end surface of the rotor 2 a second shaft 9 protrudes, which is journalled in the radial direction by a bearing sleeve 10, to which lubricant (oil) is supplied through a channel 11. Furthermore, the shaft 9 and the rotor 2 are journalled in one axial direction by an antifriction bearing 12, which includes a first bearing ring 14 mounted on an outer portion 15 of the shaft 9 by means of a piston 16A and a nut 17. The antifriction bearing 12 also includes a second bearing ring 18 and roll bodies 19 located between the bearing rings. The second or outer bearing ring 18 is supported in the axial direction by a radial surface 20 of the housing 1.

When the compressor is in operation, the rotor 2 is subjected to both a radial force and an axial force by the medium which is compressed. The radial force is transmitted to the housing 1 by the bearing sleeves 4 and 10. The axial force F, by which the compressed medium acts upon the rotor 2, is assumed in the drawing to act in the direction of the arrow 21. When the load on the rotors from the medium which is compressed is increased, the axial Force $F_a$ increases. When the rotors are unloaded by said medium, it is assumed in the drawing that a possible axial movement of the rotor 2 in a direction opposite to the direction of the arrow 21 is hindered by an end surface 7 of the rotor 2 abutting against a wall 8 of the housing 1.

The force $F_a$ is transmitted from the rotor 2 to the housing 1 via the shaft 9, the shaft portion 15, nut 17, piston 16A, inner bearing ring 14, roll bodies 19, the outer bearing ring 18 and the radial surface 20. In order that the slide bearings at the shafts 3 and 9 shall work, it is required that the shafts 3 and 9 be journalled with a certain radial movability in the sleeves 4 and 10. Therefore, the surface 20 is arranged radially so that the bearing ring 18 can follow the radial movements of the shafts 3 and 9.

The piston 16A is arranged on the shaft portion 15 to counteract the force $F_a$, so that the axial force which the bearing 12 transmits is decreased.

The piston 16A in FIG. 1 has a circular-cylindrical surface 22A which is broken by annular grooves 23A. The surface 22A cooperates with an annular element 24A mounted on the bearing ring 18, so that an annular sealing space is formed between the element 24A and the surface 22A. The piston 16A and the element 24A thus do not touch each other.

The piston 16A is acted upon by the same oil which lubricates the slide bearing at the shaft 9 and the bearing 12. The oil is introduced through the channel 11, from which it flows between the bearing rings 14 and 18 to a chamber 25A formed between the bearing 12 and the piston 16A. The pressure in chamber 25A is substantially the same as in the channel 11, which is fed with oil under pressure. From the chamber 25A, the oil leaks through the sealing space between the piston 16A and the element 24A to a chamber 26 subjected to a pressure which, for example, is the same as the suction pressure of the compressor. The oil leaves the chamber 26 through a channel 27.

In the embodiment according to FIG. 2, the piston 16B cooperates directly with an end surface of the outer ring 18. The sealing space here has a radial extension. Here too, a piston 16B and the bearing ring 18 do not touch each other.

I claim:

1. In a screw compressor, the combination of a housing, a rotor shaft rotatably journalled in the housing with a radial clearance, an antifriction bearing through which an axial force is transmitted from the rotor shaft to the housing, said bearing including first and second bearing rings and roll bodies located between the two bearing rings, the first bearing ring being mounted on the rotor shaft, the second bearing ring being supported in the axial direction by the housing and being radially movable relative to the housing, a piston mounted on the shaft in concentric relation thereto, and means for conducting a fluid under pressure to said piston to decrease said axial force transmitted from the rotor shaft to the housing, the combination being characterized by a surface which is stationary relative to the second bearing ring and which cooperates with said piston to form a narrow passage for allowing restricted discharge of said pressure fluid from the piston.

2. The combination of claim 1, in which the second bearing ring is located, as viewed in the axial direction of the rotor shaft, between its support against the housing and said piston.

3. The combination of claim 2, in which said surface with which the piston cooperates is formed by an annular element protruding axially from the second bearing ring toward the piston.

4. The combination of claim 2, in which said surface with which the piston cooperates is a radial surface of the second bearing ring.

* * * * *